United States Patent [19]

Eunbong

[11] Patent Number: 4,801,242

[45] Date of Patent: Jan. 31, 1989

[54] FIN ATTACHMENT FOR MICROWAVE OVEN DISPERSING FANS

[75] Inventor: Yoo Eunbong, Kyungkido, Rep. of Korea

[73] Assignee: Samsung Electronics Ltd., Rep. of Korea

[21] Appl. No.: 76,084

[22] Filed: Jul. 21, 1987

[30] Foreign Application Priority Data

Jul. 21, 1986 [KR] Rep. of Korea ..... 86-10561

[51] Int. Cl.[4] ..... F04D 29/38

[52] U.S. Cl. ..... 416/62; 416/237

[58] Field of Search ..... 416/62, 236 R, 237 R, 416/227 R, DIG. 3

[56] References Cited

U.S. PATENT DOCUMENTS

| | | | |
|---|---|---|---|
| 1,055,947 | 3/1913 | Schwartzberg | 416/62 |
| 1,423,964 | 7/1922 | Oswald | 416/237 R |
| 2,116,849 | 5/1938 | Rosner | 416/62 |
| 2,148,555 | 2/1939 | Hicks | 416/237 R |
| 2,265,625 | 12/1941 | Buck | 416/62 |
| 2,385,070 | 9/1945 | Gant | 416/237 R |
| 2,825,414 | 3/1958 | Page | 416/237 R X |
| 2,825,540 | 3/1958 | Merz et al. | 416/62 X |
| 2,990,889 | 7/1961 | Welch | 416/62 |
| 3,827,482 | 8/1974 | Pope | 416/236 R X |
| 4,618,313 | 10/1986 | Mosiewicz | 416/62 X |

FOREIGN PATENT DOCUMENTS

| | | | |
|---|---|---|---|
| 444829 | 2/1949 | Italy | 416/62 |
| 289311 | 3/1965 | Netherlands | 416/237 R |
| 93455 | 11/1938 | Sweden | 416/237 R |
| 348466 | 5/1931 | United Kingdom | 416/236 R |
| 496700 | 12/1938 | United Kingdom | 416/62 |
| 2100558B | 12/1982 | United Kingdom . | |

*Primary Examiner*—Everette A. Powell, Jr.

*Attorney, Agent, or Firm*—Saidman, Sterne, Kessler & Goldstein

[57] ABSTRACT

A supplementary fin for attachment to the blades of dispersion fans in microwave ovens is disclosed. Supplementary fins 7 and 7*a* are removably attached to the underside of respective blades 2 and 2*a* of standard dispersing fan 1. To maintain balance of the fan assembly, supplementary fins 7*b* and 7*c* are attached to the top side of respective dispersing fan blades 2*b* and 2*c*. The removable attachment capability of the supplementary fins is accomplished by sliding of tongue 5 through a rectangular hole 4 so as to align a fixing hole 6 with a circular hole 3. An expandable clip 9 is inserted through holes 3 and 6 and is expanded by insertion of a pin 8 so as to removably attach the supplementary fin 7 to dispersing fan blade 2. This removable attachment capability allows optimum dispersion characteristics to be achieved for a variety of dispersing fans, fan motors, and oven air venting configurations, by simple replacement of supplementary fins with supplementary fins of different design.

18 Claims, 1 Drawing Sheet

FIG. 1
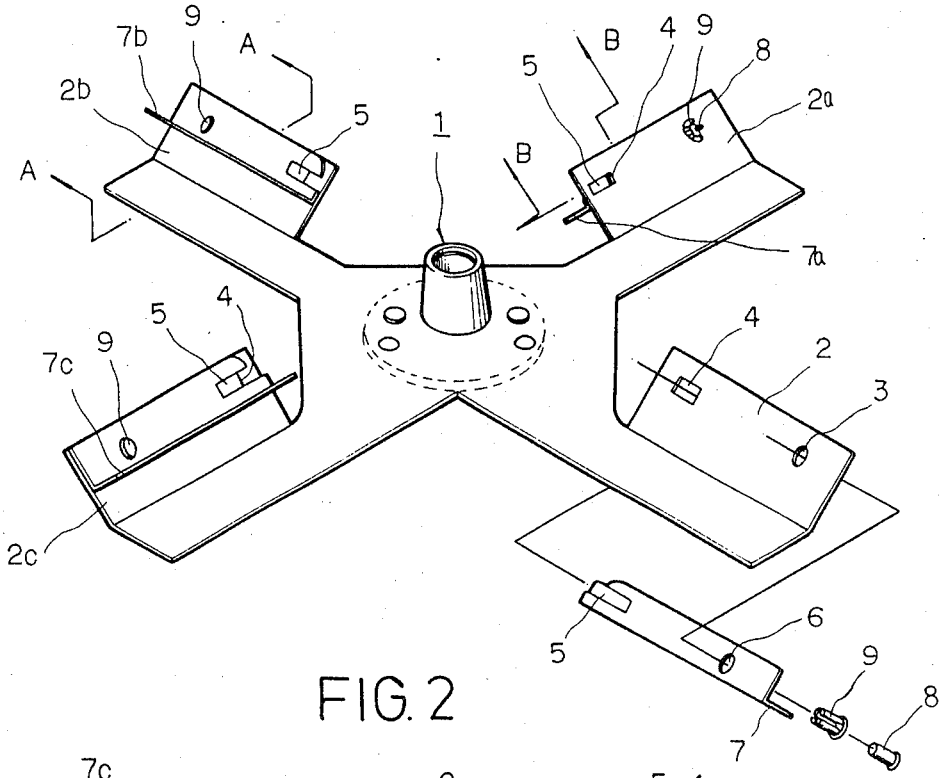
FIG. 2
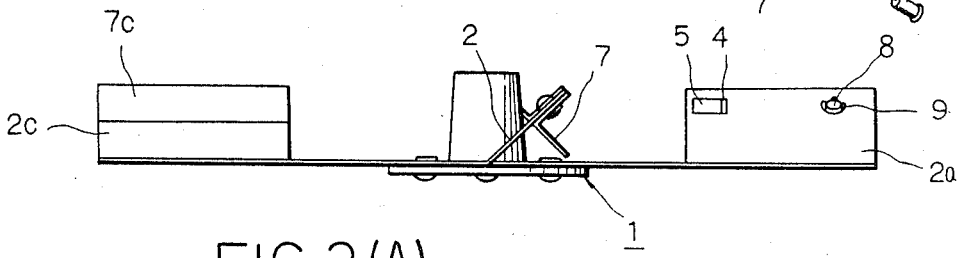
FIG. 3(A)
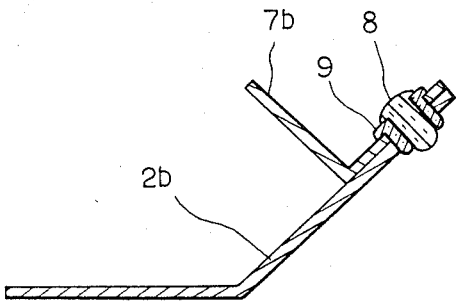
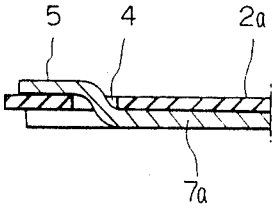
FIG. 3(B)

FIN ATTACHMENT FOR MICROWAVE OVEN DISPERSING FANS

BACKGROUND OF THE INVENTION

1. Field of the Invention

This invention relates to improvements in microwave oven dispersion fans. More specifically, the invention relates to attachments to the blades of dispersion fans for microwave ovens.

2. Related Art

Microwave ovens have often suffered the defect that the microwave energy was not evenly dispersed throughout the oven cavity during operation. At points in the oven cavity where microwaves were highly concentrated, "hot spots" were created. At points in the oven cavity where fewer microwaves were concentrated, "cold spots" were formed.

A means of achieving more even distribution of microwaves is to use fans near air inlet holes at the top of the microwave oven cavity. However, such fans must be delicately balanced so that they rotate smoothly and easily, and so that the effects of air flow on the dispersion fan are uniform. Because different configurations for circulating air into and out of the microwave oven cavity, different dispersing fans, and different fan motors are employed, it has been difficult to employ standard components and still maximize the dispersion efficiency of a particular oven cavity configuration.

SUMMARY OF THE INVENTION

The present invention comprises a supplementary fin for attachment to the blades of the dispersing fan in a microwave oven. The invention also comprises a fan assembly, which comprises the combination of a dispersing fan and the supplementary fins attached thereto. Advantageously, supplementary fins according to the present invention are attached to blades of the dispersing fan so as to modify the dispersing characteristics of the fan. The supplementary fins are removably attached to the dispersing fan blades so that, for a variety of predetermined standard dispersing fans, fan motors, and oven cavity air circulation configurations, the dispersing characteristics of the fan assembly may be altered simply by properly choosing among different supplementary fins. Advantageously, the dispersing characteristics of the fan assembly are optimized, regardless of the direction of rotation of the fan.

BRIEF DESCRIPTION OF THE DRAWINGS

The invention is best understood by reading the following detailed description of the preferred embodiment in conjunction with the following drawings, in which like reference numerals refer to like elements throughout the drawings, and in which:

FIG. 1 is a perspective view of the preferred embodiment of a fan assembly according to present invention, shown partially disassembled for purposes of illustration.

FIG. 2 is a front elevation view of the preferred embodiment of the fan assembly according to present invention.

FIGS. 3(A) and 3(B) are a cross-sectional views, magnified to show detail, in which FIG. 3(A) is a cross-sectional view taken from line A—A in FIG. 1; and FIG. 3(B) is a cross-sectional view taken from line B—B in FIG. 1.

DETAILED DESCRIPTION OF THE PREFERRED EMBODIMENT

Referring to the drawings, a dispersing fan, generally indicated as 1, comprises four blades 2, 2*a*, 2*b*, and 2*c*. In the preferred embodiments of the dispersing fan, the blades (or portions thereof) are angled upward, and are spaced at regular angles about the hub of the dispersing fan 1.

Two blades 2 and 2*a* are angled upwards in a first rotational direction which is opposite to the direction of the upward angle of the two remaining blades 2*b* and 2*c*. Each blade has means by which supplementary fins may be attached, as described below. In hhe preferred embodiment, a circular hole 3 and a rectangular hole 4 are located on the angled portion of the fins for facilitating this attachment.

Supplementary fins 7 and 7*a* are designed to be attached to the bottom of blades 2 and 2*a*, respectively. In operation, these supplementary fins help to draw air into the microwave oven cavity. As shown in FIG. 1, supplementary fin 7 is shown detached from blade 2 for the purposes of illustration. Supplementary fins 7*a*, 7*b* and 7*c* are shown actually attached to fan blades 2*a*, 2*b*, and 2*c*, respectively, as they would be in operation.

In the preferred embodiment, these supplementary fins are removably attached so as to facilitate the replacement of the supplementary fins with supplementary fins of different designs. A tongue 5 on supplementary fin 7 is designed to slip into rectangular hole 4 on blade 2 (see also FIG. 3(B)). When the tongue 5 of supplementary fin 7 has been properly inserted through rectangular hole 4, circular hole 3 is aligned with a fixing hole 6 located on supplementary fin 7. After circular hole 3 is aligned with fixing hole 7, an expandable clip 9 is inserted through both holes 3 and 6, and a pin 8 is inserted into the hollow center of expandable clip 9 (see also FIG. 3 (A)). Expandable clip 9 therefore expands to ensure that supplementary fin 7 is secured to blade 2 for reliable operation.

The fan assembly (shown in FIG. 1 as viewed from above) may be installed at the top of a microwave oven cavity during operation, so that the direction of motion of air is from the top of FIG. 1 toward the bottom of FIG. 1. In the preferred embodiment, two supplementary fins 7 and 7*a* are attached to the bottom (in the direction of air flow) of blades 2 and 2*a*, whereas two additional supplementary fins 7*b* and 7*c* are attached on the top surfaces of dispersing fan blades 2*b* and 2*c*. The attachment of four substantially identical supplementary fins ensures that the fan assembly is properly balanced. If only supplementary fins 7 and 7*a* were attached, one side of the fan assembly would be more heavily weighted than the other side, upsetting the delicate balance necessary for optimum dispersion.

The attachment of supplementary fins 7, 7*a*, 7*b* and 7*c* alters the deflection characteristics of the blades to which they are attached. Through proper choice of the size, shape, orientation, and angle between the faces of the supplementary fin, optimization of the dispersion characteristics of the fan assembly for a given oven cavity may be achieved, for example, by empirical methods.

The stability of the dispersing fan's characteristics, and its reduced sensitivity to the particular pattern of air flow in the microwave oven cavity, allows greater freedom in placement of air venting holes. In using the preferred embodiment, the venting hole may be located at the bottom of the cavity so that the microwave oven need not be placed on a table, as was required in many known microwave ovens.

Although a particular preferred embodiment of the present invention has been described above, the preferred embodiment has been shown by way of example, and not limitation. For example, it should be understood that the invention envisions application to dispersing fans having other than four blades. Various other means of attaching, or removably attaching, supplementary fins to the dispersing fan blades may be readily substituted for the attachment means described above. Also, the size, shape, quantity and angle of the supplementary fins, or of the dispersing fan blades themselves, may be altered while still remaining within the spirit and scope of the present invention. Thus, the scope of the present invention should not be defined by the embodiment described above, but should be limited only in accordance with the following claims.

What is claimed is:

1. A supplementary fin for attachment to a dispersing fan in a microwave oven, the supplementary fin comprising:

attachment means for attaching the supplementary fin to a blade of the dispersing fan; and a supplementary fin dispersing surface for modifying dispersing characteristics of the dispersing fan.

2. The supplementary fin of claim 1, wherein:

said attachment means is located on a second surface of the supplementary fin located at an angle to said supplementary fin dispersing surface.

3. The supplementary fin of claim 2, wherein:

said angle is 90°.

4. The supplementary fin of claim 1, wherein:

the supplementary fin is removably attached to said blade.

5. The supplementary fin of claim 4, wherein said attachment means comprises:

a tongue for insertion into a corresponding matched hole on said blade;

one or more fixing holes; and clipping means for penetrating said one or more fixing holes to firmly but removably attach said supplementary fin to said blade.

6. The supplementary fin of claim 5, wherein each said clipping means comprises:

an expandable clip for penetrating each said fixing hole; and a pin for insertion into, and expansion of, said expandable clip.

7. A dispersing fan assembly for a microwave oven, the assembly comprising:

a dispersing fan comprising a plurality of dispersing fan blades; and one or more supplementary fins attached to corresponding dispersion fan blades for modifying dispersing characteristics of said dispersing fan.

8. The fan assembly of claim 7, wherein each said supplementary fin comprises:

attachment means for attaching each said supplementary fin to one of said dispersing fan blades; and a supplementary fin dispersing surface.

9. The fan assembly of claim 8, wherein:

said attachment means is located on a second surface of said supplementary fin located at an angle to said supplementary fin dispersing surface.

10. The fan assembly of claim 9, wherein:

said angle is 90°.

11. The fan assembly of claim 8, wherein:

said supplementary fins are removably attached to one of said dispersing fan blades.

12. The fan assembly of claim wherein said attachment means comprises:

a tongue for insertion into a corresponding matched hole on said one of said dispersing fan blades;

one or more fixing holes; and one or more clipping means for penetrating said one or more fixing holes to firmly but removably attach each said supplementary fin to said one of said dispersing fan blades.

13. The fan assembly of claim 12, wherein each said clipping means comprises:

an expandable clip for penetrating each said fixing hole; and a pin for insertion into, and expansion of, said expandable clip.

14. The fan assembly of claim 7, wherein:

said dispersing fan comprises four dispersing fan blades;

two supplementary fins are attached to the underside of two adjacent dispersing fan blades; and two more supplementary fins are attached to the top side of the two remaining dispersing fan blades.

15. The fan assembly of claim 7, wherein:

said dispersing fan rotates in either of two directions.

16. A supplementary fin for attachment to a dispersing fan in a microwave oven, the supplementary fin comprising:

attachment means for attaching the supplementary fin to a blade of the dispersing fan; and a supplementary fin dispersing surface for modifying dispersing characteristics of the dispersing fan;

wherein said supplementary fin is removably attached to the dispersing fan.

17. A dispersing fan assembly for a microwave oven, the assembly comprising:

a dispersing fan comprising a plurality of dispersing fan blades; and one or more supplementary fins attached to corresponding dispersing fan blades for modifying dispersing characteristics of said dispersing fan, each of said supplementary fins comprising:

attachment means for attaching each said supplementary fin to one of said dispersing fan blades; and a supplementary fin dispersing surface;

wherein said supplementary fins are removably attached to said dispersing fan blades.

18. A dispersing fan assembly for a microwave oven, the assembly comprising:

a dispersing fan comprising a plurality of dispersing fan blades, said dispersing fan capable of rotating in either of two directions; and one or more supplementary fins attached to corresponding dispersing fan blades for optimizing dispersing characteristics of said dispersing fan regardless of the direction of rotation of said dispersing fan.

* * * * *